US011793286B2

(12) United States Patent
Rusakov et al.

(10) Patent No.: US 11,793,286 B2
(45) Date of Patent: Oct. 24, 2023

(54) GEAR HOOKS FOR SPORTS BAGS

(71) Applicant: Easton Diamond Sports, LLC, Thousand Oaks, CA (US)

(72) Inventors: Dmitry Rusakov, Montreal (CA); Allan Wong, Hong Kong (HK); Abraham Peters, Los Angeles, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 409 days.

(21) Appl. No.: 17/093,499

(22) Filed: Nov. 9, 2020

(65) Prior Publication Data

US 2022/0142320 A1 May 12, 2022

(51) Int. Cl.

| | |
|---|---|
| ***A45C 13/10*** | (2006.01) |
| ***A45F 3/04*** | (2006.01) |
| ***A45C 3/00*** | (2006.01) |

(52) U.S. Cl.

CPC ..... *A45C 13/10* (2013.01); *A45C 3/00* (2013.01); *A45F 3/04* (2013.01); *A45C 2003/007* (2013.01)

(58) Field of Classification Search

CPC ..... A45C 13/10; A45C 3/00; A45C 2003/007; A45C 3/12; A45F 3/04; A45F 2003/001; Y10T 24/1394

USPC ..... 224/222

See application file for complete search history.

(56) References Cited

U.S. PATENT DOCUMENTS

| | | | | | |
|---|---|---|---|---|---|
| 567,198 | A | * | 9/1896 | Richardson | A41F 1/00 24/670 |
| 4,860,905 | A | * | 8/1989 | Schott | A47F 5/0823 248/222.52 |
| 5,251,743 | A | * | 10/1993 | Pulido | A45F 5/02 206/38.1 |
| D364,269 | S | | 11/1995 | Sabosky | |
| D382,105 | S | | 8/1997 | Bonaldi | |
| 5,673,830 | A | * | 10/1997 | Matthews | B25H 3/006 224/904 |
| 5,687,892 | A | * | 11/1997 | Johns | A45F 5/02 224/904 |

(Continued)

OTHER PUBLICATIONS

U.S. Appl. No. 29/757,761, filed Nov. 9, 2020, Dmitry Rusakov.

(Continued)

*Primary Examiner* — John K Fristoe, Jr.
*Assistant Examiner* — Justin Caudill
(74) *Attorney, Agent, or Firm* — Perkins Coie LLP

(57) ABSTRACT

Gear hooks may be attached to the exterior of a bag, such as a sports bag, to carry gear outside of the bag. In some embodiments, a gear hook may include a base portion, an attachment portion extending from the base portion, a neck portion extending transversely from the base portion, and an arm portion extending transversely from the neck portion. The arm portion may be spaced apart from the base portion to form a gap configured to receive one or more objects (gear) for carrying the one or more objects on the outside of the bag. The attachment portion may be stitched into or onto the bag. In some embodiments, the attachment portion may include a flange extending outwardly from the base portion and generally parallel to the base portion. In some embodiments, the attachment portion may include a spine extending transversely from the base portion.

11 Claims, 10 Drawing Sheets

(56) References Cited

U.S. PATENT DOCUMENTS

| | | | | |
|---|---|---|---|---|
| 5,909,833 | A | 6/1999 | Smith | |
| D415,343 | S | 10/1999 | Maddox | |
| 6,234,436 | B1 * | 5/2001 | Kump | A47F 5/0823 248/220.21 |
| 6,467,665 | B1 | 10/2002 | Jenkins | |
| D479,907 | S | 9/2003 | Ruiz | |
| D487,628 | S | 3/2004 | Mathews | |
| D544,766 | S | 6/2007 | Hayes et al. | |
| D547,059 | S * | 7/2007 | Keller | D3/233 |
| D670,903 | S | 11/2012 | Ormsbee | |
| 8,590,698 | B1 * | 11/2013 | Osborne | A45F 5/021 206/5 |
| D716,181 | S | 10/2014 | Mcadams | |
| D716,182 | S | 10/2014 | Mcadams | |
| D728,259 | S | 5/2015 | Gnanendran | |
| D747,104 | S | 1/2016 | Ford | |
| D759,369 | S | 6/2016 | Mei Yee | |
| D781,571 | S | 3/2017 | Moerer | |
| D787,814 | S | 5/2017 | Kim et al. | |
| 9,717,308 | B2 * | 8/2017 | Bowerman | A44B 11/02 |
| 9,770,086 | B2 | 9/2017 | Prisco et al. | |
| D834,316 | S | 11/2018 | Tobyansen et al. | |
| D841,978 | S | 3/2019 | Ou | |
| D855,328 | S | 8/2019 | Tobyansen et al. | |
| D872,991 | S | 1/2020 | Grill | |
| 10,527,388 | B2 * | 1/2020 | Son | A44B 11/04 |
| 10,531,724 | B2 * | 1/2020 | Woodhams | A45F 5/021 |
| 10,568,394 | B2 * | 2/2020 | Eynav | A44B 99/00 |
| 2004/0065709 | A1 * | 4/2004 | Dillenberger | A45F 5/02 224/904 |
| 2006/0191110 | A1 | 8/2006 | Howell et al. | |
| 2007/0045973 | A1 * | 3/2007 | Grosso | B62B 1/264 280/47.26 |
| 2007/0170220 | A1 * | 7/2007 | Fragassi, III | B25H 3/006 224/660 |
| 2009/0057359 | A1 | 3/2009 | Chen | |
| 2009/0314678 | A1 * | 12/2009 | Stein | A45C 15/00 206/494 |
| 2010/0006728 | A1 * | 1/2010 | Portz | A47G 25/0607 248/304 |
| 2012/0128271 | A1 * | 5/2012 | Dias | A45C 3/001 112/475.08 |
| 2012/0272483 | A1 * | 11/2012 | Moore | F16B 2/22 24/3.12 |
| 2013/0212898 | A1 * | 8/2013 | Reynolds | A45C 13/30 34/239 |
| 2014/0373429 | A1 * | 12/2014 | Kurowski | B62B 13/043 43/54.1 |
| 2015/0158172 | A1 * | 6/2015 | Conway | B25H 3/02 206/349 |
| 2016/0157588 | A1 | 6/2016 | Ford | |
| 2017/0190043 | A1 * | 7/2017 | Hintze | F16B 45/02 |
| 2017/0305355 | A1 * | 10/2017 | Sotome | A47G 29/00 |
| 2018/0319615 | A1 * | 11/2018 | Matheny | A45F 5/021 |
| 2019/0047137 | A1 * | 2/2019 | Allen | B25H 3/00 |

OTHER PUBLICATIONS

U.S. Appl. No. 29/757,762, filed Nov. 9, 2020, Dmitry Rusakov.

Eastern Woods Outdoors, "Kydex Molle J-Hook", URL: https://doublesteps.com/product/kydex-molle-j-hook/, Exact publication date unknown; web page visited Oct. 9, 2020.

Oakley, "Kitchen Sink Backpack", URL: https://www.oakleysi.com/en-us/product/92060A, Exact publication date unknown; web page visited Oct. 9, 2020.

Easton , "Walk-Off Adult Baseball & Fastpitch Softball Backpack Bag Series", first available Jul. 29, 2021, amazon.com [online], [site visited Feb. 6, 2023], Available at URL: https://www.amazon.com/dp/B09BG1FG18/ref=emc_b_5_t?th=1 (Year: 2021).

Easton , "Walk-Off Adult Baseball & Fastpitch Softball Backpack Bag Series", first available Jul. 29, 2021, amazon.com [online], [site visited Feb. 6, 2023], Available at URL: https://www.amazon.com/dp/B09BG1FG18/ref=emc_b_5_t?th=1 (Year: 2022).

Hawson , "2 inch Tie Clips for Men", first available Jan. 24, 2018, amazon.com [online], [site visited Feb. 6, 2023], Available at URL: https://www.amazon.com/HAWSON-Mens-Skinny-Personalized-Anniversary-Business/dp/B09K42V2FD/ (Year: 2018).

* cited by examiner

GEAR HOOKS FOR SPORTS BAGS

BACKGROUND

Baggage, such as backpacks, duffel bags, luggage, or other baggage, is traditionally configured to carry items or gear within the interior of the baggage. Some baggage, such as a backpack or duffel bag for sports players, may include a discrete compartment for shoe storage. Internal storage, however, is not ideal for soiled shoes or other dirty items, and it does not allow for particularly quick access. Storing shoes inside the bag also uses space that may otherwise be useful for storing other items.

SUMMARY

Gear hooks configured in accordance with embodiments of the present technology may be attached to the exterior of a bag, such as a sports bag, to carry gear outside of the bag. In some embodiments, a gear hook may include a base portion, an attachment portion extending from the base portion, a neck portion extending transversely from the base portion, and an arm portion extending transversely from the neck portion. The arm portion may be spaced apart from the base portion to form a gap configured to receive one or more objects (gear) for carrying the one or more objects on the outside of the bag. The attachment portion may be stitched into or onto the bag. In some embodiments, the attachment portion may include a flange extending outwardly from the base portion and generally parallel to the base portion. In some embodiments, the attachment portion may include a spine extending transversely from the base portion. Embodiments of the present technology also include bags and gear-carrying systems that include gear hooks.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to gear hooks for baggage, and associated systems and methods. Various embodiments of the technology will now be described. The following description provides specific details for a thorough understanding and enabling description of these embodiments. One skilled in the art will understand, however, that the technology may be practiced without many of these details. Additionally, some well-known structures or functions, such as structures or functions common to baggage or stitching, may not be shown or described in detail to avoid unnecessarily obscuring the relevant description of the various embodiments. Accordingly, embodiments of the present technology may include additional elements or exclude some of the elements described below with reference to FIGS. 1A-8B, which illustrate examples of the technology.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to backpacks. Embodiments of the present technology may be implemented in other baggage, such as duffel bags or luggage. Embodiments of the present technology may also be implemented in other applications in which objects may be carried on a surface of another object.

Figure 1B:
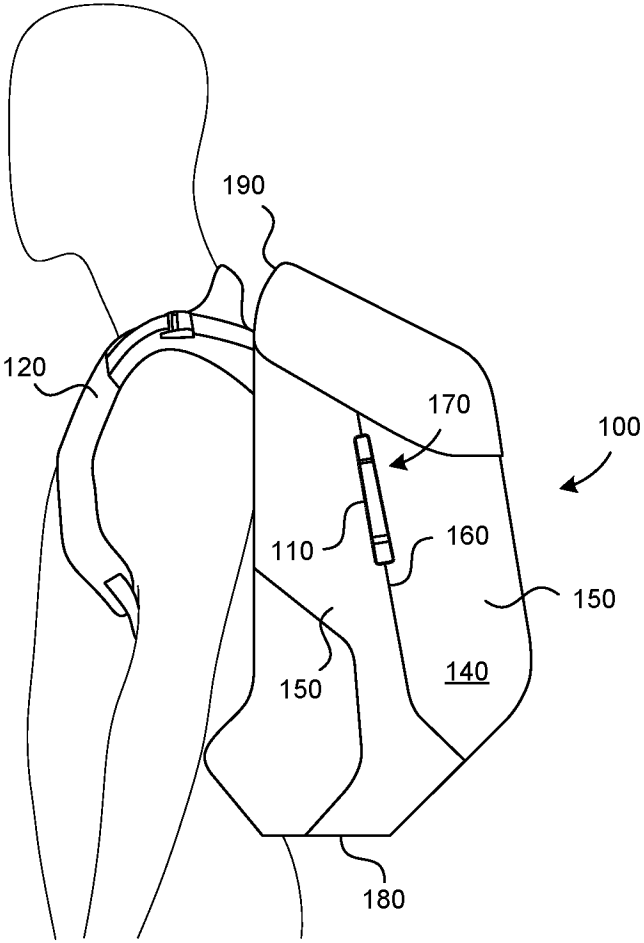
FIG. 1B illustrates a side view of the backpack shown in FIG. 1A.
Figure 1A:
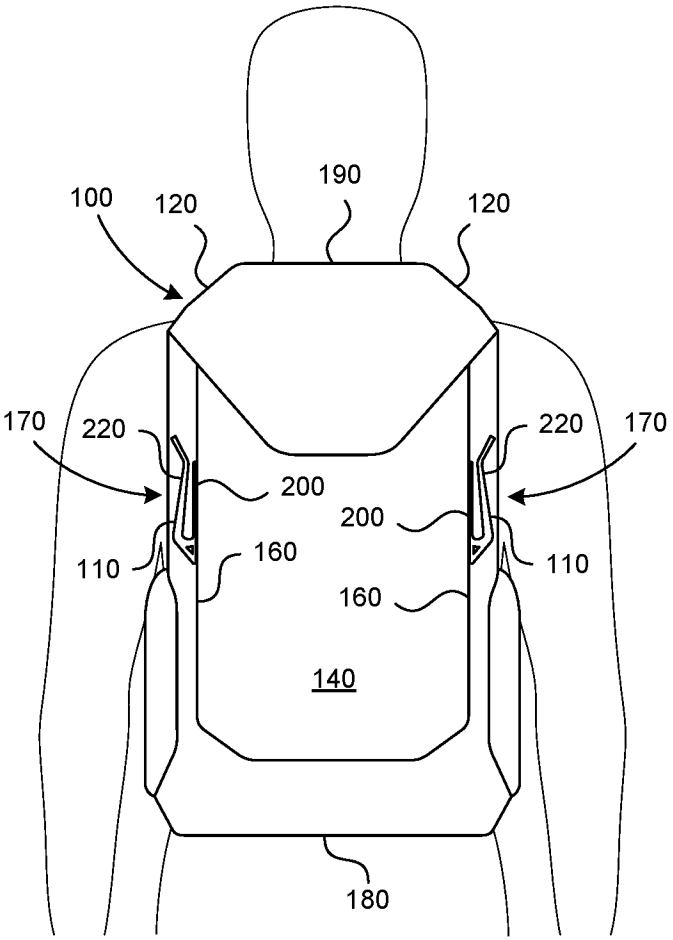
FIG. 1A illustrates a posterior view of a backpack with two gear hooks configured in accordance with embodiments of the present technology.

Turning now to the drawings, FIG. 1A illustrates a posterior view of a backpack 100 with two gear hooks 110 configured in accordance with embodiments of the present technology. FIG. 1B illustrates a side view of the backpack 100 shown in FIG. 1A. With reference to both FIGS. 1A and 1B, a backpack 100 may include one or more (such as two) straps 120 for holding the backpack 100 on a user's body, and one or more interior storage compartments within an exterior portion 140. The exterior portion 140, which forms a bag or container for the one or more interior storage compartments, may be formed with one or more panels 150 of material joined together at seams 160. In some embodiments, the backpack 100 may be generally similar to backpacks or baggage known in the art, with the exception that one or more gear hooks 110 may be included on the exterior portion 140 in accordance with embodiments of the present technology. For example, in some embodiments, one or more gear hooks 110 may be positioned on an exterior lateral side 170 of the backpack 100. In some embodiments, each opposing lateral side 170 of the backpack 100 may carry one or more gear hooks 110. In some embodiments, one or more gear hooks 110 may be positioned between, and spaced apart from, a bottom 180 of the backpack 100 and a top 190 of the backpack 100. In various embodiments, the one or more gear hooks 110 may be positioned in any suitable exterior location of the backpack 100. Although two gear hooks 110 are shown in FIGS. 1A and 1B, in some embodiments, one gear hook 110 may be omitted, or in other embodiments, more than two gear hooks 110 may be positioned on the exterior portion 140 of the backpack 100.

As described in additional detail below, the one or more gear hooks 110 may hold or secure gear on the outside of the backpack 100. For example, one or more shoes, gloves (such as batting gloves or ball gloves), or other gear may be held or carried by the one or more gear hooks 110. The exterior position of the one or more gear hooks 110 allows a user to carry gear outside of the one or more interior storage compartments of the backpack 100, which helps prevent introduction of dirt or moisture into the one or more interior storage compartments.

Figure 2A:
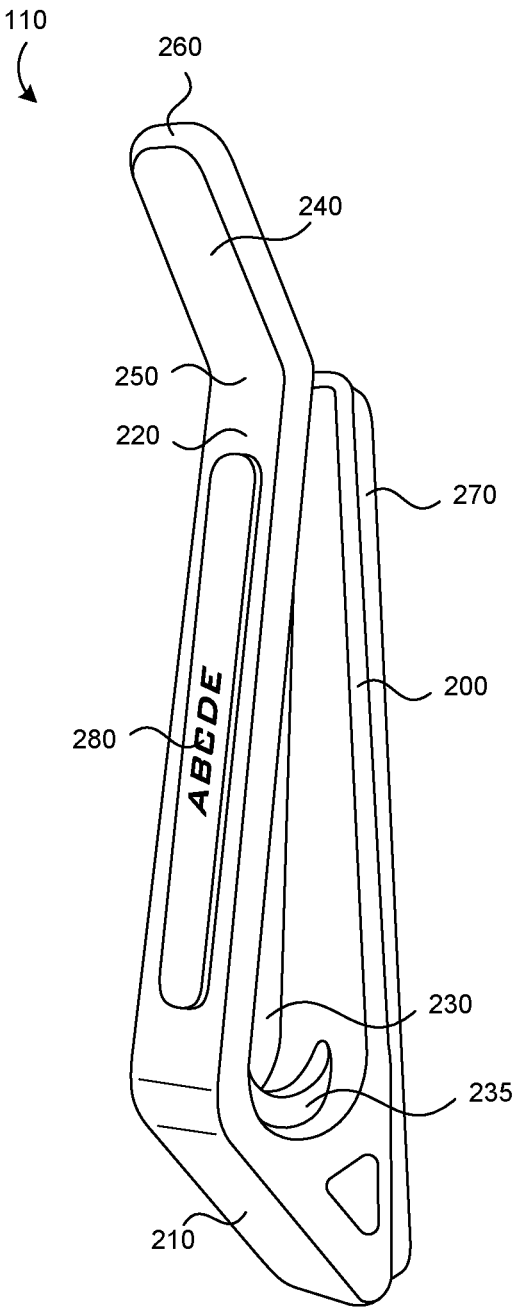
FIG. 2A illustrates a perspective view of a gear hook configured in accordance with embodiments of the present technology.
Figure 2B:
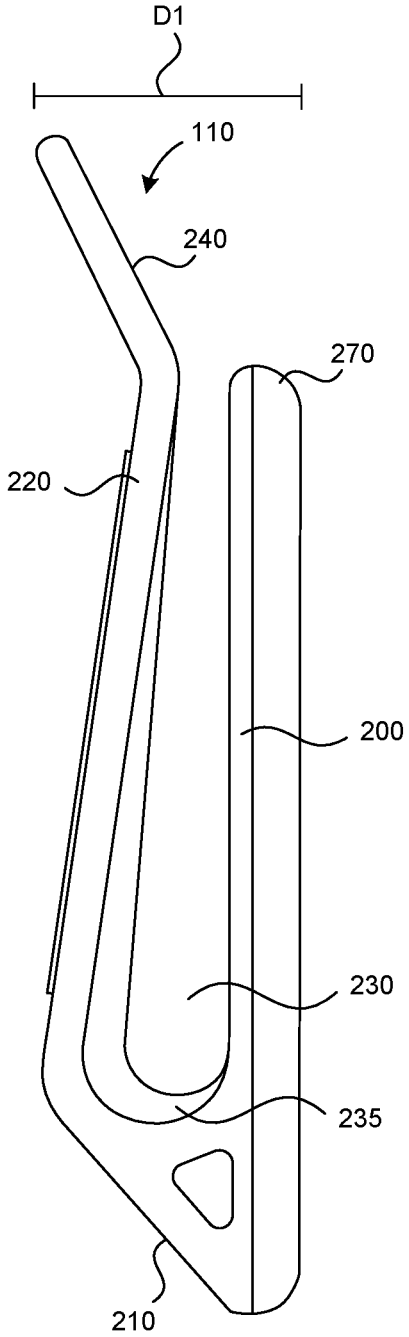
FIG. 2B illustrates a profile view of the gear hook shown in FIG. 2A.
Figure 2C:
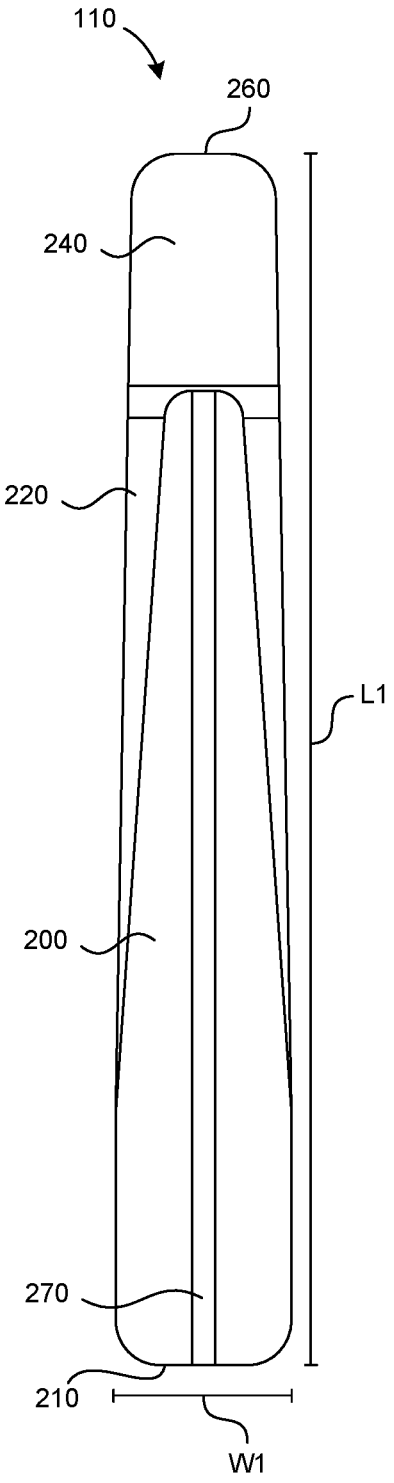
FIG. 2C illustrates a side view of the gear hook shown in FIG. 2A, facing a base portion of the gear hook.
Figure 2D:
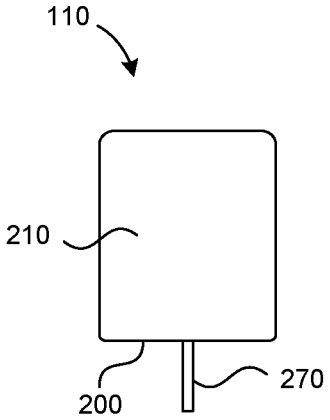
FIG. 2D illustrates a bottom view of the gear hook shown in FIG. 2A, facing a neck portion of the gear hook.

FIG. 2A illustrates a perspective view of a gear hook 110, configured in accordance with embodiments of the present technology. FIG. 2B illustrates a profile view of the gear hook 110 shown in FIG. 2A. FIG. 2C illustrates a side view of the gear hook 110 shown in FIG. 2A, facing a base portion 200 of the gear hook 110. FIG. 2D illustrates a bottom view of the gear hook 110 shown in FIG. 2A, facing a neck portion 210 of the gear hook 110.

With reference to FIGS. 2A, 2B, 2C, and 2D, in some embodiments, the gear hook 110 may include the base portion 200, the neck portion 210 (which extends transversely from the base portion 200), and an arm portion 220 (which extends transversely from the neck portion 210). The neck portion 210 may connect the base portion 200 to the arm portion 220. In some embodiments, the neck portion 210 may be omitted and the base portion 200 may be directly connected to the arm portion 220. In some embodiments, a gap 230 is formed between the arm portion 220 and the base portion 200. In some embodiments, the arm portion 220 and the base portion 200 are only connected or in contact at one location (such as at the neck portion 210). In other embodiments, the arm portion 220 may contact the base portion 200 at other locations. The gap 230 is configured to receive one or more objects or gear to carry the objects or gear outside of the backpack 100 (see FIGS. 1A, 1B). In some embodiments, the gear hook 110 may include a support rib 235 positioned in the gap 230, extending along the arm portion 220 in the gap 230 and terminating near the connection between the neck portion 210 and the base portion 200. The support rib 235 may extend transversely from the arm portion 220, the neck portion 210, and part of the base portion 200, into the gap 230. The support rib provides further durability and strength for the gear hook 110 (specifically, for the arm portion 220 and the portion of the gear hook 110 that flexes at the neck portion 210).

In some embodiments, the gear hook 110 may include a kick portion 240 extending transversely from the arm portion 220. The kick portion 240 is optional and may facilitate easier connection of gear to the gear hook 110 (for example, by providing easier access to the gap 230). The kick portion 240 may include a root portion 250 attached to the arm portion 220, and a free end 260 opposite the root portion 250. The kick portion 240 may extend along an outward direction from the root portion 250 to the free end 260, such that the outward direction is transverse to the base portion 200 and extends away from the base portion 200. In some embodiments, the kick portion 240 may extend in other directions (for example, toward the base portion 200), or the kick portion 240 may be omitted.

In some embodiments, the base portion 200 may include, or may carry, an attachment portion 270 for attaching the gear hook 110 to a backpack or other baggage. For example, as generally illustrated in FIGS. 2A, 2B, 2C, and 2D, an attachment portion 270 may include a spine extending transversely from the base portion 200 (for example, extending along a direction that is transverse to the base portion 200, such as perpendicularly from the base portion 200). With additional reference to FIG. 1B, in some embodiments, the base portion 200 may be positioned adjacent to a seam 160 of the backpack 100. The attachment portion 270 may be stitched into the seam 160. For example, the attachment portion 270 may be positioned between two or more panels 150 and stitching for the seam may pass through the attachment portion 270 to lock the attachment portion 270 in the seam 160. In other words, the attachment portion 270 may be stitched into the seam 160. In some embodiments, the arm portion 220 may include indicia 280, such as a logo or nomenclature to indicate a name or a suggested use of the gear hook 110.

Gear hooks 110 configured in accordance with embodiments of the present technology may have any dimensions suitable for attachment to baggage (such as a backpack 100) and for supporting gear. For example, with reference to FIG. 2C, in some embodiments, a gear hook 110 may have an overall length L1 (from the free end 260 to the farthest opposite portion of the neck portion 210) of four inches to five inches. In some embodiments, a gear hook 110 may have a width W1 of approximately 0.5 inches to one inch. With reference to FIG. 2B, in some embodiments, a gear hook 110 may have a depth D1 of approximately 0.9 inches to 1.1 inches.

Figure 3B:
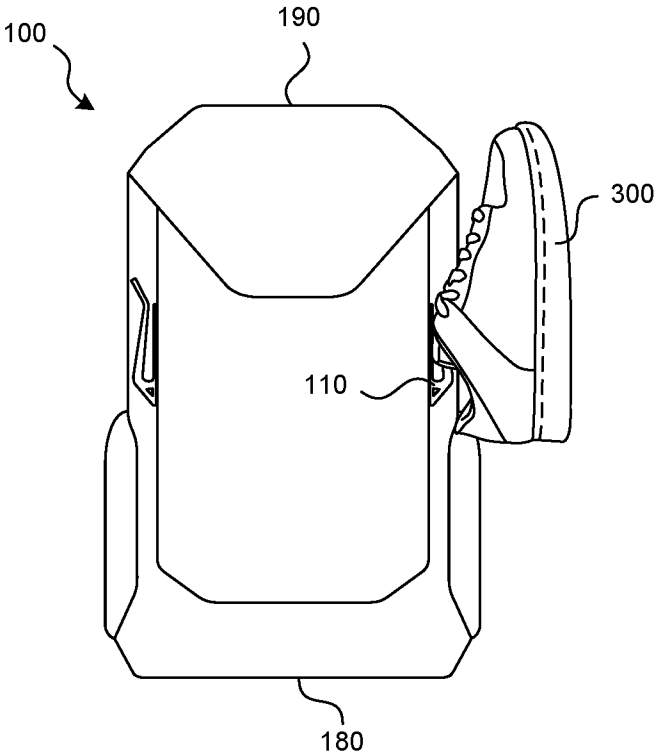
FIGS. 3A and 3B illustrate perspective views of use of a gear hook on baggage, such as a backpack, in accordance with embodiments of the present technology.
Figure 3A:
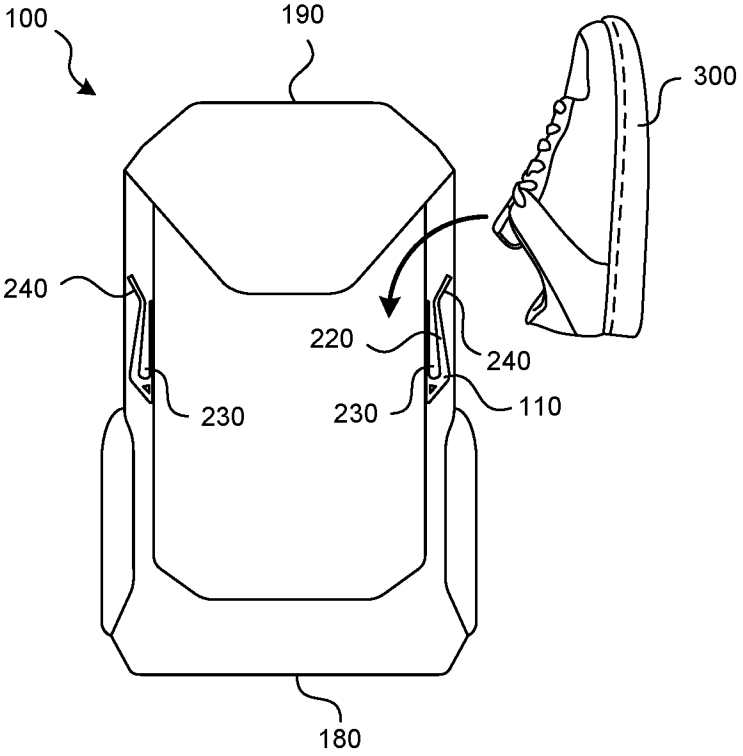

FIGS. 3A and 3B illustrate perspective views of use of a gear hook 110 on baggage, such as a backpack 100, in accordance with embodiments of the present technology. The gap 230 may be oriented to have an open end closer to the top 190 of the backpack than the bottom 180 of the backpack in order to receive an item of gear 300 with the assistance of gravity holding the item of gear 300 in engagement with the gear hook 110. The item of gear 300 may be a shoe, a water bottle, a glove, a sandal, a towel, or other gear suitable for carrying on baggage. The item of gear 300 may be hooked onto the gear hook 110. For example, a tongue portion of a shoe or the laces of the shoe may be positioned in the gap 230 and the arm portion 220 of the gear hook 110 may be positioned in the shoe. The angle of the kick portion 240 can assist the user with positioning gear on the gear hook 110.

Figure 4A:
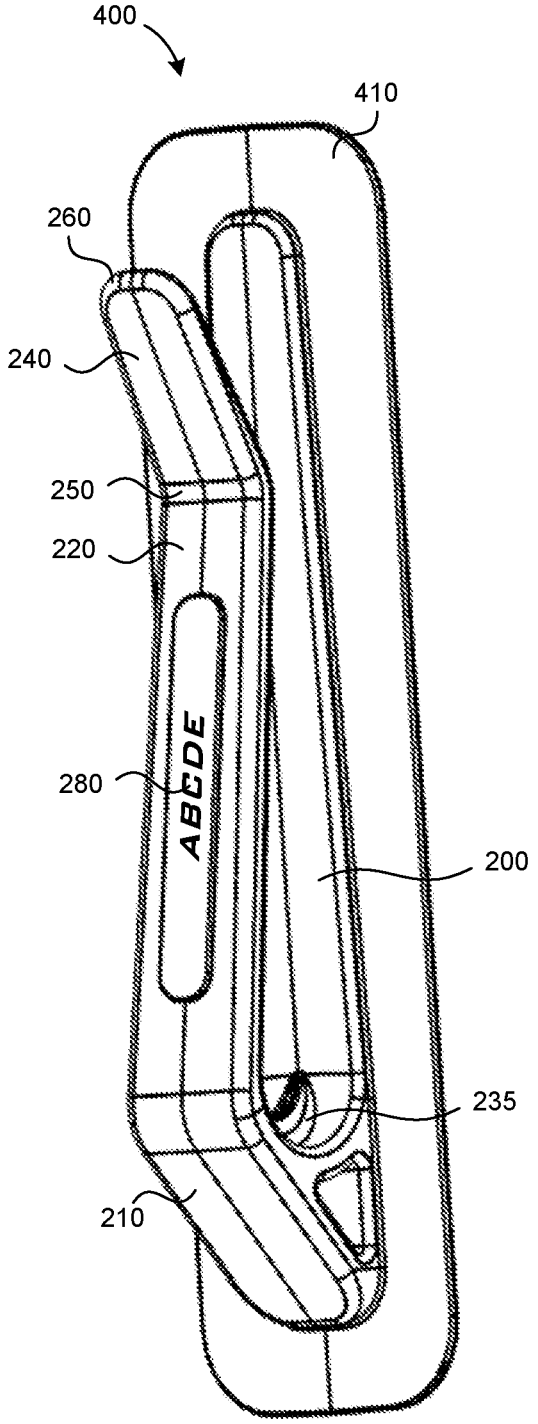
FIG. 4A illustrates a perspective view of a gear hook configured in accordance with other embodiments of the present technology.
Figure 4B:
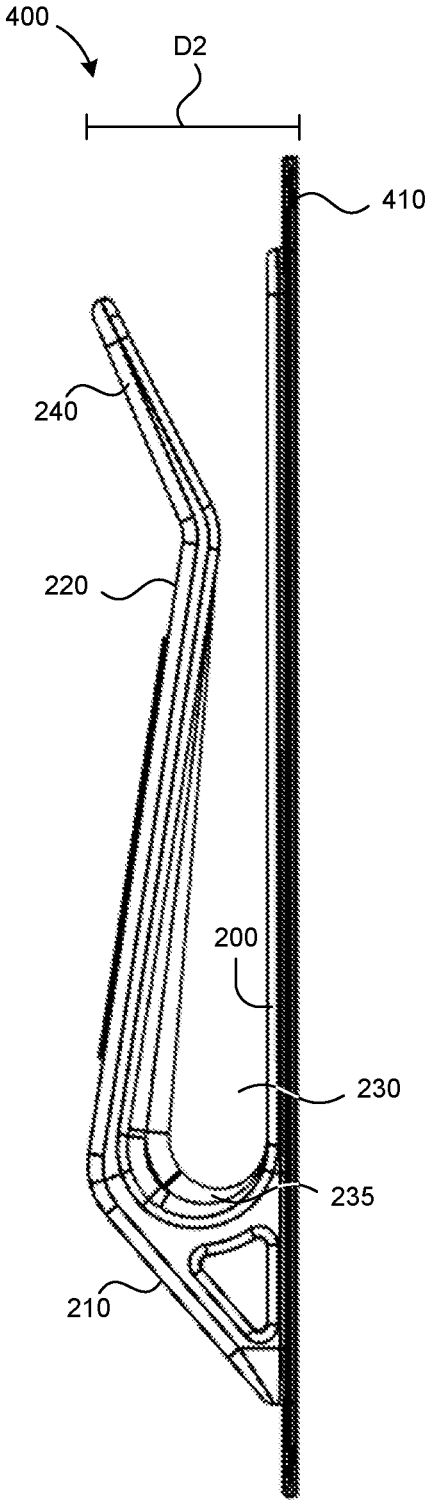
FIG. 4B illustrates a profile view of the gear hook shown in FIG. 4A.
Figure 4C:
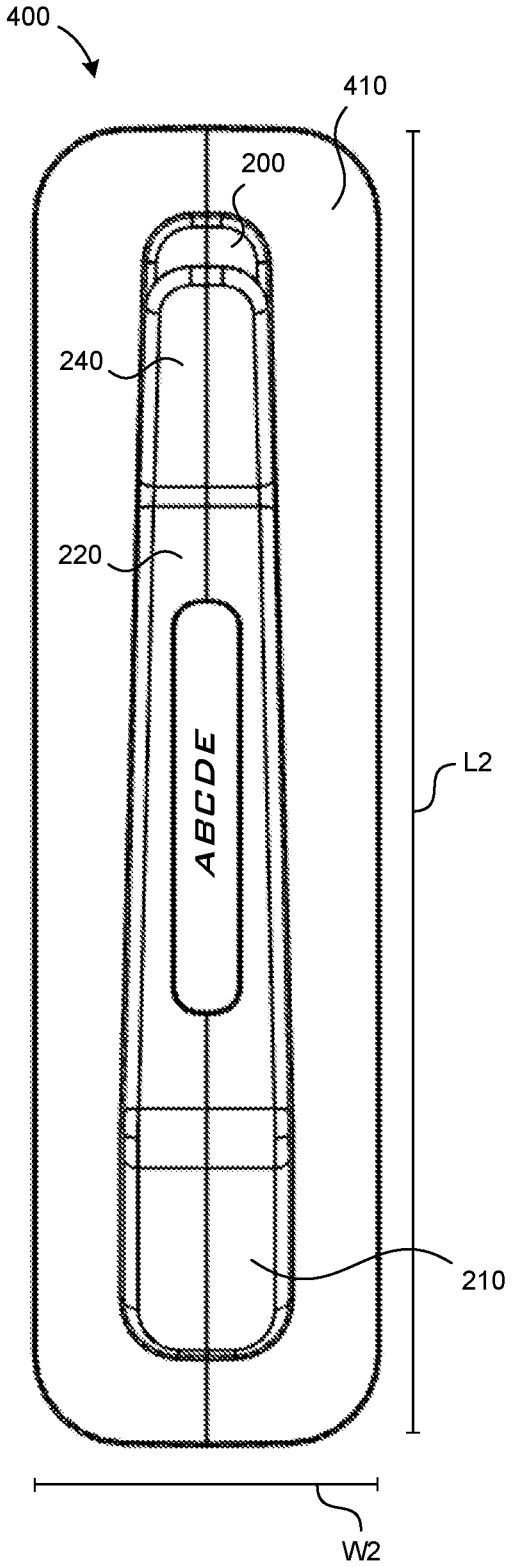
FIG. 4C illustrates a side view of the gear hook shown in FIG. 4A, facing an arm portion of the gear hook.
Figure 4D:
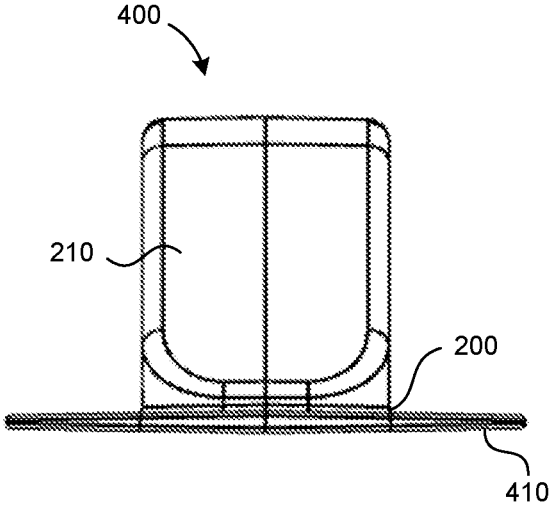
FIG. 4D illustrates a bottom view of the gear hook shown in FIG. 4A, facing a neck portion of the gear hook.

FIG. 4A illustrates a perspective view of a gear hook 400 configured in accordance with additional embodiments of the present technology. The gear hook 400 may be similar or even identical to the gear hook described above with regard to FIGS. 1A-2D, with the exception that instead of a spine as the attachment portion 270 (see FIGS. 2A-2D), the gear hook 400 may include an attachment portion 410 in the form of a flange, as described in additional detail below. FIG. 4B illustrates a profile view of the gear hook 400 shown in FIG. 4A. FIG. 4C illustrates a side view of the gear hook 400 shown in FIG. 4A, facing the arm portion 220 of the gear hook 400. FIG. 4D illustrates a bottom view of the gear hook 400 shown in FIG. 4A, facing the neck portion 210 of the gear hook 400.

With reference to FIGS. 4A, 4B, 4C, and 4D, the flange (the attachment portion 410) may extend outwardly from the base portion 200 and generally parallel to the base portion 200. In some embodiments, the flange may be formed as a sheet or panel upon which the base portion 200 may be mounted, or the base portion 200 may be integral with the flange.

Gear hooks 400 configured in accordance with embodiments of the present technology may have any dimensions suitable for attachment to baggage and for supporting gear. For example, with reference to FIG. 4C, in some embodiments, a gear hook 400 may have an overall length L2 of five inches to six inches. In some embodiments, a gear hook 400 may have a width W2 of approximately one to two inches. With reference to FIG. 4B, in some embodiments, a gear hook 400 may have a depth D2 of approximately 0.8 inches to 1.0 inches.

Figure 5:
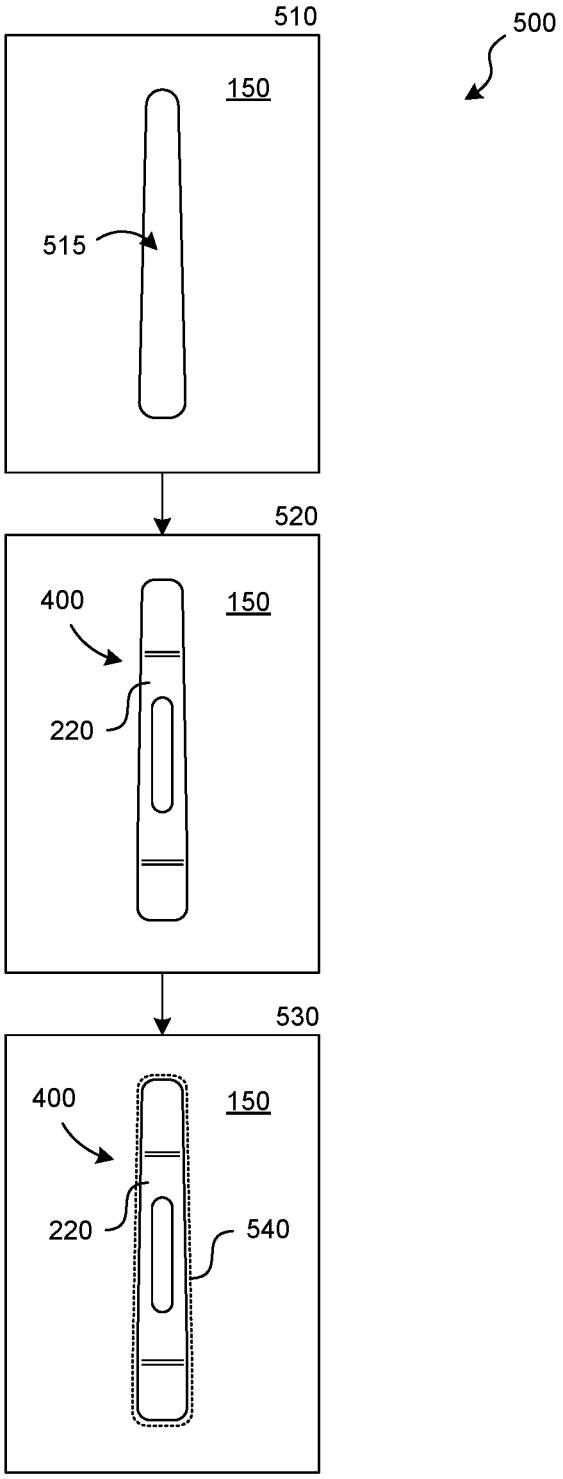
FIG. 5 shows a flow diagram illustrating a method for attaching a gear hook to a panel of a piece of baggage, in accordance with embodiments of the present technology.

The attachment portion 410 may be stitched into or onto a panel 150 or between two or more panels 150. For example, FIG. 5 shows a flow diagram 500 illustrating a method for attaching a gear hook 400 to a panel 150. At block 510, a hole 515 may be cut in the panel 150. The hole 515 may be cut with die cutting, laser cutting, or other suitable ways to cut materials. At block 520, the panel 150 is positioned over the gear hook 400 (or the gear hook 400 is positioned beneath the panel 150), such that the arm portion 220 and, optionally, the base portion 200 (not visible in FIG. 5, but understood to be obscured in FIG. 5 by the arm portion 220), protrude through the hole 515 in the panel 150.

The attachment portion 410 (the flange) may be sized to be larger than the hole 515 to prevent the attachment portion 410 from passing through the hole 515. At block 530, one or more lines of stitching 540 may be positioned to pass through the panel 150 and the attachment portion 410 (the flange) to secure the gear hook 400 to the panel 150. In some embodiments, the attachment portion 410 may be secured to the panel 150 using adhesive or other suitable attachment devices, as an alternative to or in addition to the one or more lines of stitching 540. Upon assembly, the panel 150 may be positioned between the attachment portion 410 (the flange) and the arm portion 220.

Figure 6:
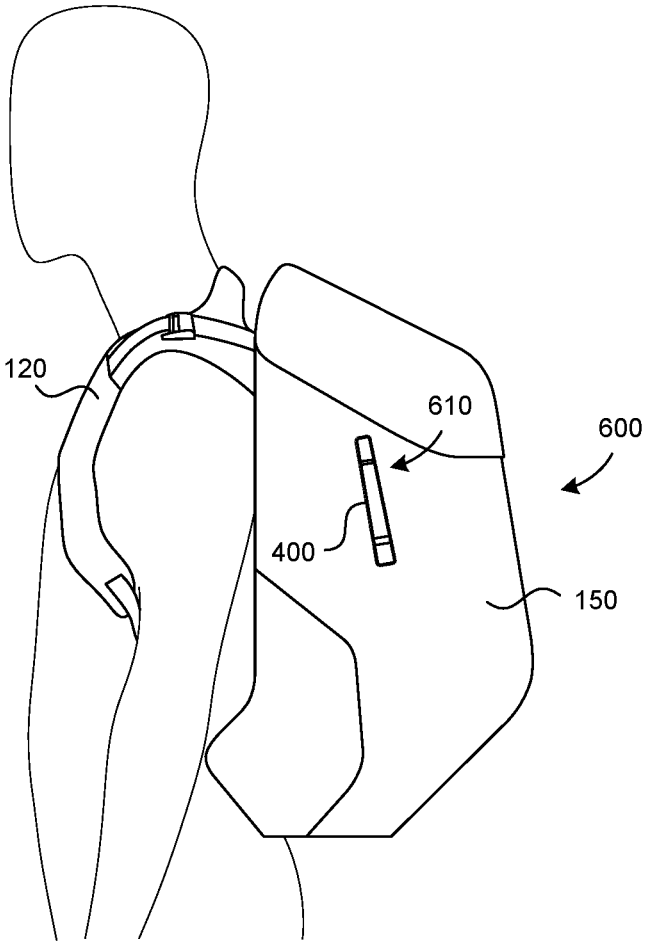
FIG. 6 illustrates a side view of a backpack with a gear hook positioned on an exterior lateral side of the backpack, in accordance with embodiments of the present technology.

FIG. 6 illustrates a side view of a backpack 600 with a gear hook 400 positioned on an exterior lateral side 610 of the backpack. In some embodiments, one or more gear hooks 400 may be positioned on each exterior lateral side 610 of the backpack 600 (for example, in positions similar to the gear hooks 110 on the backpack 100 described above with regard to FIG. 1A).

Figure 7B:
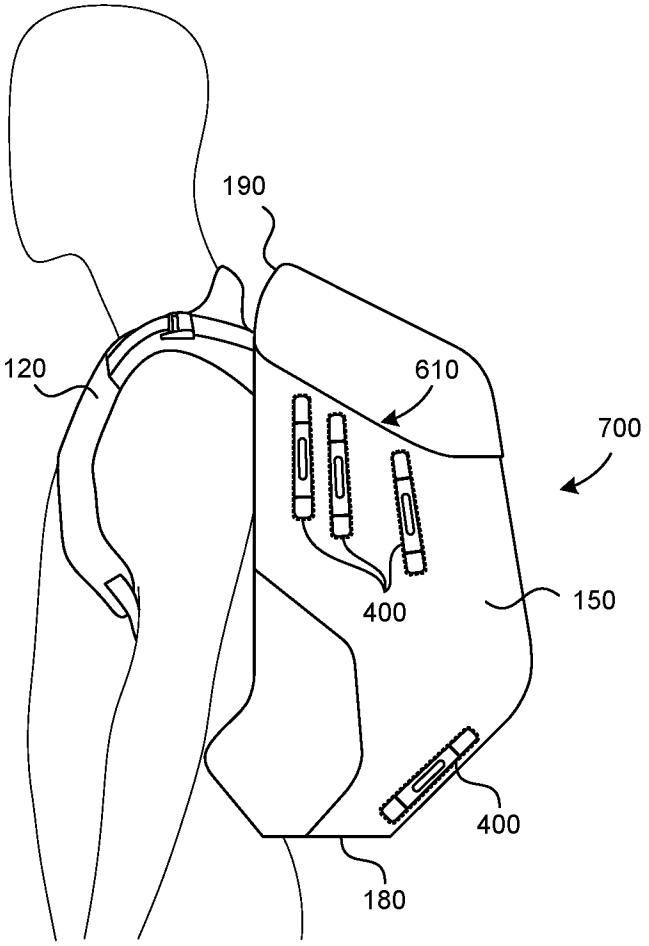
FIGS. 7A and 7B illustrate a posterior view and a side view, respectively, of backpacks having gear hooks positioned in various locations on the backpacks, in accordance with embodiments of the present technology.
Figure 7A:
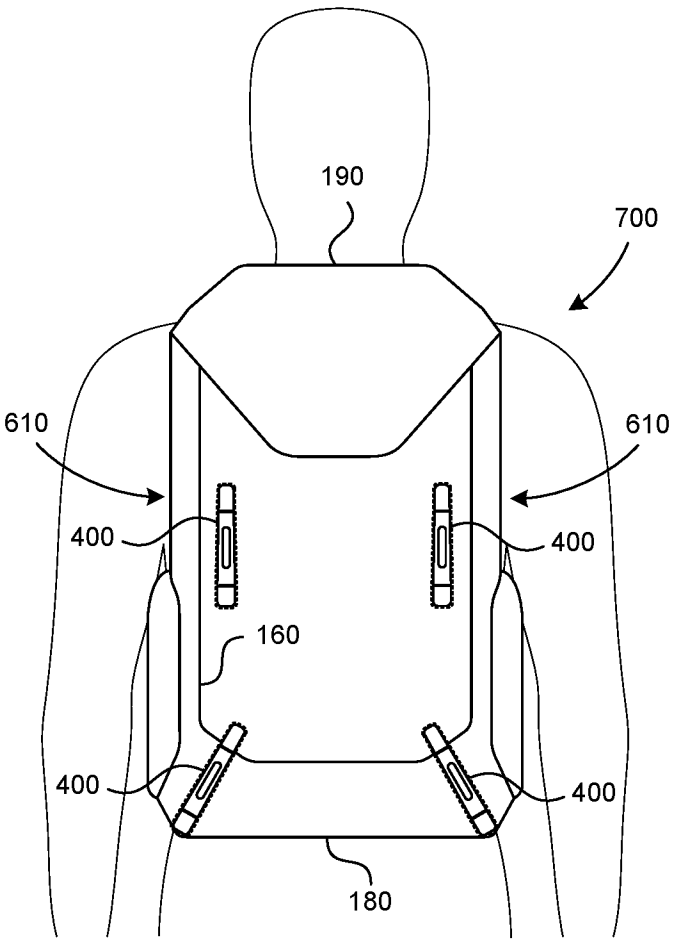

FIGS. 7A and 7B illustrate a posterior view and a side view, respectively, of a backpack 700 having gear hooks 400 positioned in various locations on the backpack 700. In some embodiments, gear hooks 110 described above with regard to FIGS. 2A-2D may be positioned in these locations. In some embodiments, the gear hooks 110, 400 may be positioned sufficiently far from the bottom 180 of the backpack 700 to prevent the shoe or other gear from dangling beneath the bottom 180. In some embodiments, gear hooks 110, 400 may be positioned at or near the bottom 180 of the backpack 700. Backpacks or other baggage can include any suitable number and position of gear hooks 110, 400.

Figure 8A:
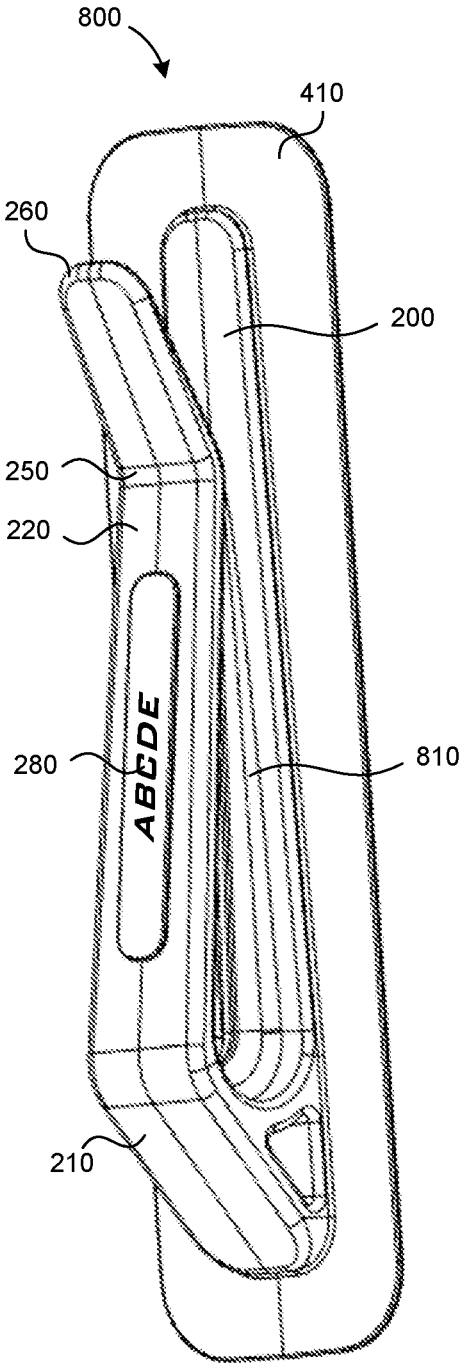
FIG. 8A illustrates a perspective view of a gear hook configured in accordance with other embodiments of the present technology.
Figure 8B:
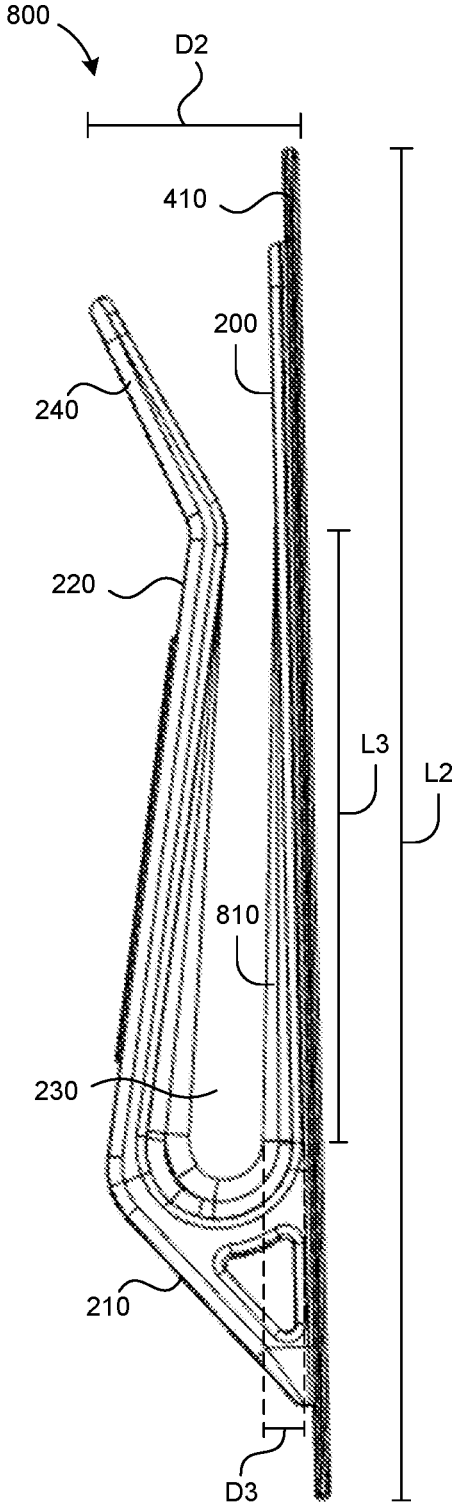
FIG. 8B illustrates a profile view of the gear hook shown in FIG. 8A.

FIG. 8A illustrates a perspective view of a gear hook 800 configured in accordance with other embodiments of the present technology. FIG. 8B illustrates a profile view of the gear hook 800 shown in FIG. 8A. In some embodiments, gear hooks 800 may be similar or identical to the gear hooks 400 described above with regard to FIGS. 4A-4D, with the exception that, instead of having a support rib that terminates near the connection between the neck portion 210 and the base portion 200 (see element 235 in FIGS. 2A, 2B, 4A, and 4B), the gear hooks 800 may include an extended support rib 810.

The extended support rib 810 may be like the support rib 235 described above, except that it may further extend along at least a majority of the length of the base portion 200 to add further durability and support to the gear hooks 800. For example, if a gear hook 800 has an overall length L2 between five and six inches, then in some embodiments, the extended support rib 810 may extend along a length L3 from the termination of the connection between the neck portion 210 by a distance of two to three inches (for example, 2.6 inches). The extended support rib 810 may taper from a width or depth D3 of 0.1 to 0.2 inches to a width or depth of approximately zero inches along the length L3. In some embodiments, the support rib 810 may have a width or thickness (along the dimension W2 shown in FIG. 4C) of 0.2 to 0.3 inches.

Gear hooks 110, 400, 800 configured in accordance with embodiments of the present technology may be formed using any material suitable for providing structural strength to hold gear while also being penetrable to facilitate pass-through of stitches, such as a thermoplastic polyurethane (TPU) material, Nylon 6 polyamide, another suitable polymer, or another generally rigid yet penetrable material. In some embodiments, the material forming a gear hook need not be penetrable. In further embodiments, the material may include holes (formed by drilling, cutting, or other suitable ways to create holes) to facilitate stitching into the panels 150 or seams 160. In some embodiments, gear hooks 110, 400, 800 may be cast, molded, machined, made with three-dimensional printing, or otherwise suitably formed. For simplicity in manufacturing, preferably, gear hooks 110, 400, 800 configured in accordance with embodiments of the present technology are formed in one single integral piece, although they may be formed from multiple pieces joined together with fasteners, adhesive, or other suitable ways to join pieces together.

Gear hooks 110, 400, 800 configured in accordance with embodiments of the present technology provide several advantages. For example, they facilitate carrying of gear outside of baggage, which allows for more room inside of the baggage and helps to keep the inside of the baggage clean (for example, by keeping dirty shoes outside of the bag). The gear hooks 110, 400, 800 may facilitate drying of wet shoes as opposed to keeping them inside of the baggage. The low profile of the gear hooks 110, 400, 800 helps maintain a low profile for the baggage overall, and helps avoid obstructions caused by use of webbing, straps, or other parts.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. Although specific dimensions are provided herein, such dimensions are for example only and other embodiments may have other sizes.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A bag comprising a storage compartment and a gear hook positioned on an exterior portion of the bag, wherein the gear hook comprises:

a base portion positioned adjacent to a seam of the bag, the base portion including a spine extending perpendicularly from the base portion, wherein the spine is stitched into the seam;

a neck portion extending transversely from the base portion;

an arm portion extending transversely from the neck portion; and a kick portion extending transversely from the arm portion, the kick portion having a root portion attached to the arm portion, the kick portion also having a free end, wherein the kick portion extends along an outward direction from the root portion to the free end, wherein the outward direction is transverse to the base portion and extends away from the base portion;

wherein the arm portion is spaced apart from the base portion to form a gap configured to receive one or more objects for carrying the one or more objects on the exterior portion of the bag.

2. The bag of claim 1, wherein the gear hook is positioned on an exterior lateral side of the bag.

3. The bag of claim 1, wherein the gear hook is above and spaced apart from a bottom of the bag.

4. A gear hook configured to be positioned on an exterior portion of a bag, the gear hook further configured to be stitched to the bag, wherein the gear hook comprises:

a base portion;

a spine extending transversely from the base portion, wherein the spine is configured to be stitched into a seam of the bag;

a neck portion extending transversely from the base portion; and an arm portion extending transversely from the neck portion;

wherein the arm portion is spaced apart from the base portion to form a gap configured to receive one or more objects for carrying the one or more objects on the outside of the bag.

5. The gear hook of claim 4, further comprising a kick portion extending transversely from the arm portion.

6. The gear hook of claim 5, wherein the kick portion comprises a root portion attached to the arm portion and a free end positioned away from the root portion, wherein the kick portion extends along a direction from the root portion to the free end that is transverse to the base portion and extends away from the base portion.

7. The gear hook of claim 4, further comprising a support rib extending from the arm portion, the neck portion, and the base portion, wherein the support rib is positioned in the gap and extends along at least part of a length of each of the arm portion, the neck portion, and the base portion.

8. The gear hook of claim 4, wherein the gear hook is formed as a single integral piece.

9. A gear-carrying system comprising a bag and a gear hook, wherein the bag comprises an interior storage compartment and an exterior portion surrounding the interior storage compartment, wherein the gear hook is attached to the exterior portion of the bag, and wherein the gear hook comprises:

a base portion;

a spine extending transversely from the base portion, wherein the spine is stitched into a seam of the bag;

a neck portion extending transversely from the base portion; and an arm portion extending transversely from the neck portion;

wherein the arm portion is spaced apart from the base portion to form a gap configured to receive one or more objects for carrying the one or more objects on the outside of the bag;

wherein the gap is oriented to have an open end closer to an upper portion of the bag than to a lower portion of the bag.

10. The gear-carrying system of claim 9, wherein the gear hook further comprises a kick portion, wherein the kick portion comprises a root portion attached to the arm portion and a free end positioned away from the root portion, wherein the kick portion extends along a direction from the root portion to the free end that is transverse to the base portion and extends away from the base portion.

11. The gear-carrying system of claim 9, wherein the gear hook is positioned on an exterior lateral side of the bag and is positioned above and spaced apart from a bottom of the bag.

* * * * *